US009750321B2

(12) United States Patent
Kandel

(10) Patent No.: US 9,750,321 B2
(45) Date of Patent: Sep. 5, 2017

(54) CASE FOR PORTABLE ELECTRONIC DEVICES WITH INTERNAL SUPPORT

(71) Applicant: Targus Group International, Inc., Anaheim, CA (US)

(72) Inventor: Michael John Kandel, Los Angeles, CA (US)

(73) Assignee: Targus Group International, Inc., Anaheim, CA (US)

( * ) Notice: Subject to any disclaimer, the term of this patent is extended or adjusted under 35 U.S.C. 154(b) by 190 days.

(21) Appl. No.: 14/720,093

(22) Filed: May 22, 2015

(65) Prior Publication Data

US 2015/0359307 A1 Dec. 17, 2015

Related U.S. Application Data

(60) Provisional application No. 62/011,674, filed on Jun. 13, 2014.

(51) Int. Cl.

| | |
|---|---|
| ***A45C 11/00*** | (2006.01) |
| ***A45C 13/02*** | (2006.01) |
| *A45C 3/02* | (2006.01) |

(52) U.S. Cl.

CPC ..... *A45C 11/00* (2013.01); *A45C 13/02* (2013.01); *A45C 3/02* (2013.01); *A45C 2011/003* (2013.01); *A45C 2013/025* (2013.01)

(58) Field of Classification Search

CPC A45C 11/00; A45C 13/02; A45C 3/02; A45C 2011/003; A45C 2013/025

See application file for complete search history.

(56) References Cited

U.S. PATENT DOCUMENTS 556,526 A * 3/1896 Baker ..... A45C 13/02 190/36

1,121,422 A 12/1914 Tydings (Continued)

FOREIGN PATENT DOCUMENTS

CA 2 758 982 A1 5/2012
CA 2 827 491 A1 9/2012

(Continued)

OTHER PUBLICATIONS

Non-Final Office Action for U.S. Appl. No. 14/874,980, filed Oct. 5, 2015, and mailed from the USPTO dated Jul. 15, 2016, 9 pgs.

(Continued)

*Primary Examiner* — Tri Mai

(74) *Attorney, Agent, or Firm* — John R. Thompson; Stoel Rives LLP

(57) ABSTRACT

According to various embodiments, a case for a portable electronic device includes first and second panels and a bottom wall defining an interior storage compartment in which an internal support is coupled to the two panels. The internal support is configured to provide convenient access to and/or impact protection for a portable electronic device enclosed therein. When the case is in an open position, the internal support may provide structure and support to allow convenient use of a portable electronic device without the need to remove it from the case. Whereas, when the case is in a closed position the internal support may cradle an enclosed portable electronic device and provide impact protection. Thus, the case may be used to support a portable electronic device in an upright position, or protect it from damage during transit.

17 Claims, 5 Drawing Sheets

(56) References Cited

U.S. PATENT DOCUMENTS 2,554,215 A 5/1951 Schell et al.
2,556,066 A 6/1951 Cline
3,023,794 A * 3/1962 Lifton ..... A45C 3/02 190/102
3,185,198 A * 5/1965 Bryan ..... A62C 99/009 169/91
3,292,778 A 12/1966 Enderle
3,441,072 A 4/1969 Schmitt
3,530,213 A 9/1970 Isle
3,620,149 A 11/1971 Ogihara
D230,376 S 2/1974 Andrew
4,106,597 A 8/1978 Shook et al.
4,259,568 A 3/1981 Dynesen
4,685,570 A * 8/1987 Medow ..... A45C 3/00 190/901
4,700,832 A 10/1987 Champ
4,901,897 A 2/1990 Briggs et al.
5,024,328 A 6/1991 Bontrager
5,165,649 A 11/1992 Neumann et al.
5,207,327 A 5/1993 Brondos
5,217,119 A * 6/1993 Hollingsworth ..... G06F 1/1628 190/102
5,330,049 A 7/1994 Bertelsen et al.
5,356,004 A 10/1994 Weinreb
5,375,076 A 12/1994 Goodrich et al.
D356,120 S 3/1995 Allen
D357,918 S 5/1995 Doria
5,480,118 A 1/1996 Cross
5,524,754 A * 6/1996 Hollingsworth ..... G06F 1/1628 190/111
5,544,792 A 8/1996 Arnwine
5,555,157 A 9/1996 Moller et al.
5,594,619 A 1/1997 Miyagawa et al.
5,607,054 A 3/1997 Hollingsworth
5,622,262 A 4/1997 Sadow
5,629,833 A 5/1997 Ido et al.
5,708,561 A 1/1998 Huilgol et al.
5,735,397 A 4/1998 Cyr
5,769,221 A 6/1998 Cyr
5,775,496 A 7/1998 Cyr
5,797,044 A 8/1998 Lawther et al.
5,887,723 A 3/1999 Myles
5,971,148 A 10/1999 Jackson
5,996,778 A 12/1999 Shih
6,079,528 A * 6/2000 Moor ..... A45C 3/02 150/128
6,082,543 A 7/2000 Béliveau
6,131,734 A 10/2000 Hollingsworth et al.
6,173,933 B1 1/2001 Whiteside et al.
6,237,766 B1 5/2001 Hollingsworth
6,334,533 B1 1/2002 Hollingsworth et al.
6,334,534 B1 1/2002 Hollingsworth et al.
D453,749 S 2/2002 Lee et al.
6,494,321 B1 12/2002 Sadow et al.
6,535,199 B1 3/2003 Canova, Jr. et al.
D476,149 S 6/2003 Andre et al.
6,746,638 B1 6/2004 Zadesky et al.
6,772,879 B1 8/2004 Domotor
6,785,566 B1 8/2004 Irizarry
D500,923 S 1/2005 Gonzalez et al.
6,856,506 B2 2/2005 Doherty et al.
D513,008 S 12/2005 Takizawa et al.
D527,176 S 8/2006 Andre et al.
D529,717 S 10/2006 Brancky
D533,348 S 12/2006 Andre et al.
7,207,154 B2 4/2007 Araujo
D541,646 S 5/2007 Hayes et a
7,281,698 B2 10/2007 Patterson, Jr.
D574,375 S 8/2008 Prest et al.
D574,819 S 8/2008 Andre et al.
7,414,833 B2 8/2008 Kittayapong
7,451,872 B1 11/2008 Allen
D582,405 S 12/2008 Andre et al.
7,467,695 B2 12/2008 Gormick et al.
7,495,895 B2 2/2009 Carnevali
7,500,561 B2 3/2009 Matias et al.
7,503,440 B2 3/2009 Gormick et al.
D593,528 S 6/2009 Shi
D600,699 S 9/2009 Johnston et al.
7,652,873 B2 1/2010 Lee
D610,111 S 2/2010 Kim et al.
7,735,644 B2 6/2010 Sirichai et al.
7,747,007 B2 6/2010 Hyun et al.
D619,554 S 7/2010 Kim et al.
D623,404 S 9/2010 Andre et al.
D623,638 S 9/2010 Richardson et al.
D623,639 S 9/2010 Richardson et al.
D628,197 S 11/2010 Li
7,835,145 B2 11/2010 Chiang et al.
D629,772 S 12/2010 Mo et al.
7,876,550 B1 1/2011 Albertini et al.
D637,814 S 5/2011 Akana et al.
8,016,107 B2 9/2011 Emsky
8,051,980 B2 11/2011 Tai et al.
8,132,670 B1 3/2012 Chen
D658,363 S 5/2012 Biddle
8,173,893 B2 5/2012 Huang
8,201,687 B2 6/2012 Zeliff et al.
8,230,992 B2 7/2012 Law et al.
8,235,208 B2 8/2012 Sirichai et al.
8,253,518 B2 8/2012 Lauder et al.
8,281,924 B2 10/2012 Westrup
8,281,950 B2 10/2012 Potts et al.
8,312,991 B2 11/2012 Diebel et al.
8,328,008 B2 12/2012 Diebel et al.
8,393,464 B2 3/2013 Yang et al.
8,395,465 B2 3/2013 Lauder et al.
8,434,601 B2 5/2013 Hou et al.
8,457,701 B2 6/2013 Diebel
8,459,453 B2 6/2013 Parker et al.
8,467,183 B2 6/2013 Probst et al.
8,522,965 B1 9/2013 Hsiung
8,544,639 B2 10/2013 Yang et al.
8,573,394 B2 11/2013 Ahee et al.
8,605,433 B2 12/2013 Chiang et al.
8,659,893 B2 2/2014 Chiou
8,783,450 B2 7/2014 Wang
8,820,525 B1 9/2014 Zanxiang
8,905,231 B2 12/2014 Couch, III et al.
8,985,543 B2 3/2015 Chen et al.
9,372,507 B2 6/2016 Dekock et al.
2001/0014010 A1 8/2001 Jenks et al.
2001/0052710 A1 12/2001 Witherell
2002/0179470 A1 12/2002 Lee
2003/0186729 A1 10/2003 Engstrom et al.
2003/0213886 A1 11/2003 Gilbert
2004/0018863 A1 1/2004 Engstrom et al.
2004/0134812 A1 7/2004 Yeh
2004/0134813 A1* 7/2004 Domotor ..... A45C 3/02 206/320
2004/0217027 A1* 11/2004 Harris ..... A45C 13/002 206/320
2004/0224732 A1 11/2004 Lee et al.
2004/0240164 A1 12/2004 Lee
2005/0057893 A1 3/2005 Homer et al.
2005/0105264 A1 5/2005 Chen
2005/0237701 A1 10/2005 Yu
2006/0007645 A1 1/2006 Chen et al.
2006/0144662 A1* 7/2006 Hu ..... A45C 13/02 190/110
2006/0226040 A1* 10/2006 Medina ..... G06F 1/1616 206/320
2007/0001079 A1 1/2007 Patterson, Jr.
2007/0056865 A1 3/2007 Pelo
2007/0057140 A1 3/2007 Liou et al.
2007/0163897 A1 7/2007 Lee
2007/0166028 A1 7/2007 Kranz et al.
2007/0279855 A1 12/2007 Linsmeier et al.
2008/0029412 A1 2/2008 Ho et al.
2008/0043411 A1 2/2008 Chih et al.
2008/0045279 A1 2/2008 Ohki
2008/0055835 A1 3/2008 Kumano et al.
2008/0226286 A1 9/2008 Huang

(56) References Cited

U.S. PATENT DOCUMENTS

| | | | | |
|---|---|---|---|---|
| 2008/0237432 | A1 | 10/2008 | Patterson | |
| 2008/0302687 | A1 | 12/2008 | Sirichai et al. | |
| 2009/0073337 | A1 | 3/2009 | Liou et al. | |
| 2009/0109558 | A1 | 4/2009 | Schaefer | |
| 2009/0127423 | A1 | 5/2009 | Chen et al. | |
| 2009/0178938 | A1 | 7/2009 | Palmer | |
| 2009/0223765 | A1 | 9/2009 | Bosma | |
| 2009/0223845 | A1 | 9/2009 | Bosma et al. | |
| 2009/0230006 | A1 | 9/2009 | Pidgley et al. | |
| 2010/0044259 | A1* | 2/2010 | Wang | A45C 3/02 206/320 |
| 2010/0072334 | A1 | 3/2010 | Le Gette et al. | |
| 2010/0082445 | A1 | 4/2010 | Hodge et al. | |
| 2010/0101975 | A1 | 4/2010 | Zhang et al. | |
| 2010/0116710 | A1 | 5/2010 | Huang et al. | |
| 2010/0225429 | A1 | 9/2010 | Tsai | |
| 2010/0232102 | A1 | 9/2010 | Walker et al. | |
| 2010/0258602 | A1 | 10/2010 | Amin | |
| 2010/0277858 | A1 | 11/2010 | Zhou | |
| 2010/0294683 | A1 | 11/2010 | Mish et al. | |
| 2010/0294909 | A1 | 11/2010 | Hauser et al. | |
| 2011/0034221 | A1 | 2/2011 | Hung et al. | |
| 2011/0090626 | A1 | 4/2011 | Hoellwarth et al. | |
| 2011/0221319 | A1 | 9/2011 | Law et al. | |
| 2011/0240448 | A1 | 10/2011 | Springer et al. | |
| 2011/0284420 | A1 | 11/2011 | Sajid | |
| 2011/0290687 | A1 | 12/2011 | Han | |
| 2011/0297566 | A1 | 12/2011 | Gallagher et al. | |
| 2011/0297581 | A1 | 12/2011 | Angel | |
| 2011/0315579 | A1 | 12/2011 | Mase | |
| 2012/0012483 | A1 | 1/2012 | Fan | |
| 2012/0168323 | A1 | 7/2012 | Schmidt et al. | |
| 2012/0176741 | A1 | 7/2012 | Wu et al. | |
| 2012/0199501 | A1 | 8/2012 | Le Gette et al. | |
| 2012/0217174 | A1 | 8/2012 | Ting | |
| 2012/0261289 | A1 | 10/2012 | Wyner et al. | |
| 2012/0298394 | A1 | 11/2012 | Huang | |
| 2013/0140194 | A1 | 6/2013 | Han | |
| 2014/0216954 | A1 | 8/2014 | Law et al. | |
| 2014/0262855 | A1 | 9/2014 | Gandhi et al. | |
| 2014/0291175 | A1 | 10/2014 | Chung et al. | |
| 2014/0347793 | A1 | 11/2014 | Gao | |

FOREIGN PATENT DOCUMENTS

| | | | |
|---|---|---|---|
| DE | 20 2010 010 388 | U1 | 1/2011 |
| EP | 1 548 544 | A2 | 6/2005 |
| EP | 2 392 986 | A2 | 12/2011 |
| EP | 2 426 571 | A2 | 3/2012 |
| EP | 2 337 373 | B1 | 12/2013 |
| GB | 2464583 | B | 7/2010 |
| JP | H073344 | U | 1/1995 |
| JP | 09135722 | A | 5/1997 |
| JP | 2000014426 | A | 1/2000 |
| JP | 2003230417 | A * | 8/2003 |
| JP | 2004509680 | A | 4/2004 |
| JP | 2006024178 | A | 1/2006 |
| KR | 20080075716 | B | 8/2008 |
| TW | 200801649 | A | 1/2008 |
| WO | WO 01/90848 | A2 | 11/2001 |
| WO | WO 2010/036090 | A2 | 4/2010 |
| WO | WO 2011/115918 | A1 | 9/2011 |
| WO | WO 2011/130157 | A2 | 10/2011 |
| WO | WO 2012/112790 | A2 | 8/2012 |

OTHER PUBLICATIONS

International Search Report and Written Opinion of PCT/US2011/039287, filed Jun. 6, 2011, and dated Dec. 28, 2011, 11 pgs.
International Preliminary Report on Patentability for PCT/US2011/039287 filed Jun. 6, 2011, and dated Dec. 20, 2012, 7 pgs.
Office Action for U.S. Appl. No. 12/370,824, filed Feb. 13, 2009, and dated Jan. 4, 2013, (19 pgs.).
Office Action for U.S. Appl. No. 13/171,225, filed Jun. 28, 2011, and mailed from the USPTO dated Apr. 16, 2013, 24 pgs.
Office Action for U.S. Appl. No. 13/285,565, filed Oct. 31, 2011, and mailed from the USPTO dated May 9, 2013, 11 pgs.
Office Action for U.S. Appl. No. 12/370,824, filed Feb. 13, 2009, and mailed from the USPTO dated May 20, 2013, 22 pgs.
Office Action for U.S. Appl. No. 13/791,445, filed Mar. 8, 2013, and mailed from the USPTO dated Jun. 21, 2013, 20 pgs.
Third-Party Submission Under 37 CFR 1.290 Concise Description of Relevance, for U.S. Appl. No. 13/791,445, filed by Raymond Meiers in Ohio dated Jul. 31, 2013, 14 pgs.
Notice of Allowance and Fee(s) Due for U.S. Appl. No. 12/370,824, filed Feb. 13, 2009, and mailed from the USPTO dated Sep. 9, 2013, 12 pgs.
Office Action for U.S. Appl. No. 13/747,992, filed Jan. 23, 2013, and mailed from the USPTO dated Oct. 23, 2013, 21 pgs.
Final Office Action for U.S. Appl. No. 13/791,445, filed Mar. 8, 2013, and mailed from the USPTO dated Oct. 23, 2013, 21 pgs.
Final Office Action for U.S. Appl. No. 13/171,225, filed Jun. 28, 2011, and mailed from the USPTO dated Dec. 4, 2013, 17 pgs.
Non-Final Office Action for U.S. Appl. No. 13/791,445, filed Mar. 8, 2013, and mailed from the USPTO dated Dec. 27, 2013, 8 pgs.
Office Action for U.S. Appl. No. 13/739,846, filed Jan. 11, 2013, dated Feb. 27, 2014, 19 pgs.
Non-final Office Action for U.S. Appl. No. 14/099,436, filed Dec. 6, 2013, and mailed from the USPTO dated Mar. 26, 2014, 18 pgs.
Notice of Allowance and Fee(s) Due for U.S. Appl. No. 29/431,992, filed Sep. 12, 2012, and mailed from the USPTO dated Apr. 2, 2014, 27 pgs.
Office Action for U.S. Appl. No. 13/791,445, filed Mar. 8, 2013, mailed from the USPTO dated Apr. 10, 2014, 9 pgs.
Notice of Allowance and Fee(s) Due for U.S. Appl. No. 13/747,992, filed Jan. 23, 2013, and mailed from the USPTO dated Apr. 16, 2014, 10 pgs.
Notice of Allowance and Fee(s) Due for U.S. Appl. No. 13/791,445, filed Mar. 8, 2013, and mailed from the USPTO dated Apr. 25, 2014, 8 pgs.
Office Action for U.S. Appl. No. 29/454,936, filed May 15, 2013, mailed from USPTO dated May 5, 2014, 22 pgs.
Office Action for U.S. Appl. No. 29/454,913, filed May 15, 2013, mailed from the USPTO dated May 7, 2014, 23 pgs.
Office Action for U.S. Appl. No. 29/454,934, filed May 15, 2013, mailed from the USPTO dated May 7, 2014, 23 pgs.
Notice of Allowance and Fee(s) Due for U.S. Appl. No. 14/099,436, filed Dec. 6, 2013, and mailed from the USPTO dated May 13, 2014, 9 pgs.
Notice of Allowance and Fee(s) Due for U.S. Appl. No. 29/452,310, filed Apr. 15, 2013, and mailed from the USPTO dated Sep. 25, 2014, 27 pgs.
Non-Final Office Action for U.S. Appl. No. 13/155,266, filed Jun. 7, 2011, and mailed from the USPTO dated Nov. 6, 2014, 35 pgs.
Non-Final Office Action for U.S. Appl. No. 13/937,027, filed Jul. 8, 2013, and mailed from the USPTO dated Feb. 3, 2015, 37 pgs.
Non-Final Office Action for U.S. Appl. No. 14/020,298, filed Sep. 6, 2013, and mailed from the USPTO dated Feb. 12, 2015, 35 pgs.
Non-Final Office Action for U.S. Appl. No. 14/341,149, filed Jul. 25, 2014, and mailed from the USPTO dated Apr. 21, 2015, 25 pgs.
Notice of Allowance for U.S. Appl. No. 13/155,266, filed Jun. 7, 2011, and mailed from the USPTO dated May 15, 2015, 8 pgs.
Non-Final Office Action for U.S. Appl. No. 13/601,799, filed Aug. 31, 2012, and mailed from the USPTO dated Sep. 13, 2016, 49 pgs.
Non-Final Office Action for U.S. Appl. No. 15/067,789, filed Mar. 11, 2016, and mailed from the USPTO dated Sep. 14, 2016, 29 pgs.
Notice of Allowance and Fee(s) Due for U.S. Appl. No. 14/341,149, filed Jul. 25, 2014, and mailed from the USPTO dated Jul. 8, 2015, 8 pgs.
Non-Final Office Action for U.S. Appl. No. 14/720,153, filed May 22, 2015, and mailed from the USPTO dated May 12, 2017, 36 pgs.
Notice of Allowance and Fee(s) Due for U.S. Appl. No. 15/255,580, filed Sep. 2, 2016, and mailed from the USPTO dated May 12, 2017, 14 pgs.
Non-Final Office Action for U.S. Appl. No. 15/255,580, filed Sep. 2, 2016, and mailed from the USPTO dated Apr. 11, 2017, 29 pgs.

(56) References Cited

OTHER PUBLICATIONS

Final Office Action for U.S. Appl. No. 13/601,799, filed Aug. 31, 2012, and mailed from the USPTO dated Apr. 19, 2017, 18 pgs.
Notice of Allowance for U.S. Appl. No. 15/067,789, filed Mar. 11, 2016, and mailed from the USPTO dated Apr. 28, 2017, 14 pgs.

* cited by examiner

CASE FOR PORTABLE ELECTRONIC DEVICES WITH INTERNAL SUPPORT

RELATED APPLICATIONS

This application claims priority to U.S. Patent Application Ser. No. 62/011,674 filed on Jun. 13, 2014, which is incorporated herein by reference.

TECHNICAL FIELD

This disclosure generally relates to cases for portable electronic devices.

BRIEF DESCRIPTION OF THE DRAWINGS

Non-limiting and non-exhaustive embodiments of the disclosure are described, including various embodiments of the disclosure with reference to the figures, in which.

In the following description, numerous specific details are provided for a thorough understanding of the various embodiments disclosed herein. The embodiments disclosed herein can be practiced without one or more of the specific details, or with other methods, components, materials, etc. In addition, in some cases, well-known structures, materials, or operations may not be shown or described in detail in order to avoid obscuring aspects of the disclosure. Furthermore, the described features, structures, or characteristics may be combined in any suitable manner in one or more alternative embodiments.

DETAILED DESCRIPTION

The present disclosure provides various embodiments of a case with internal support for securing and protecting portable electronic devices (PEDs). According to various embodiments, a case may be configured with an internal support for convenient access to and/or impact protection for a PED enclosed therein. When the case is in an open position, the internal support may provide structure and support to allow convenient use of a PED without the need to remove it from the case. Whereas, when the case is in a closed position the internal support may cradle an enclosed PED and provide impact protection.

A "portable electronic device" (PED) as used throughout the specification may include any of a wide variety of electronic devices. Specifically contemplated are laptops and tablet-style electronic devices, including, but not limited to, electronic readers, tablet computers, tablet PCs, mini tablets, phablets, cellular phones (including smart phones), interactive displays, video displays, touch screens, touch computers, etc.

Reference throughout this specification to "one embodiment" or "an embodiment" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment.

Additionally, any of a wide variety of materials and manufacturing methods may be used to produce the various components of the presently described case for portable electronic devices. For example, a case may utilize various plastics, rubbers, nylons, glasses, fabrics, leathers, and/or other suitable materials.

Figure 1:
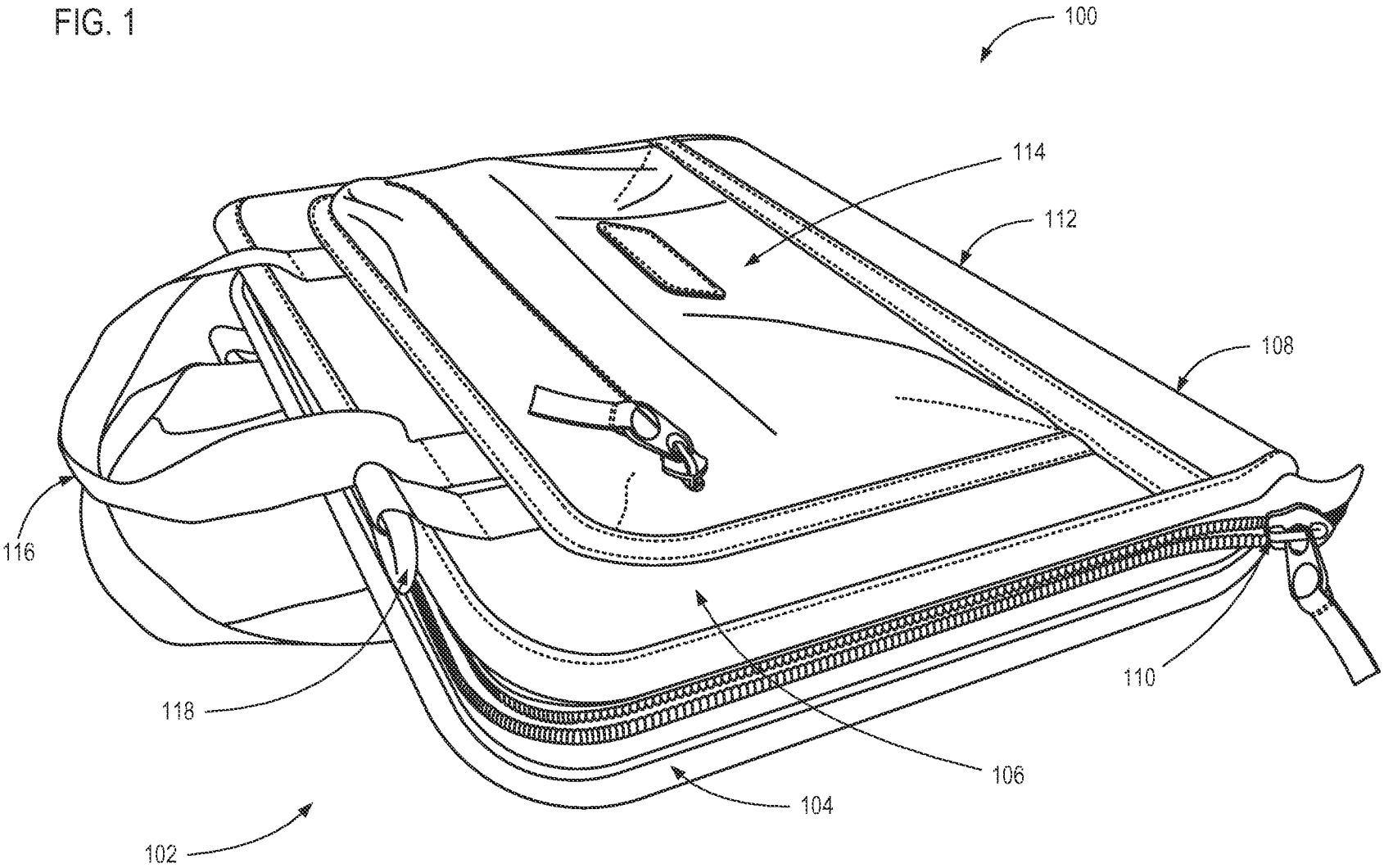
FIG. 1 is a side perspective view of a case with internal support, the case in a closed position.

FIG. 1 is a side perspective view of a case 100 in a closed position. An exterior 102 of the case 100 covers and protects an enclosed PED. The case 100 includes first and second panels 104, 106 pivotally coupled to a bottom wall 108. The first and second panels 104, 106 have inner and outer surfaces with the outer surfaces forming at least part or even the majority of the exterior 102. The first and second panels 104, 106 may be generally planar and rectangular, and may comprise one or more layers of fabric, cushion, and the like to provide protection to the PED.

In order to allow the case 100 to open and close, the panels 104, 106 may be coupled to the bottom wall 108 by a piece of flexible material, a hinge, or the like. In a closed position, the panels 104, 106 provide protection for any enclosed PED. In an open case position, a user has access to the PED. Where not coupled together, the panels 104, 106 form an opening that allows the case 100 to receive and selectively enclose a PED.

The case 100 may include one or more fasteners 110 to selectively secure the panels 104, 106 together and thereby maintain an opening of the case 100 shut. For example, the case 100 may include a zipper, clasps, buttons, snaps, magnets, and/or the like to secure a portion or the entire width of the opening. As illustrated, the fastener 110 may include a zipper extending along the sides of the panels 104, 106 except along respective bottom edges 112.

One or both panels 104, 106 may include additional elements for convenience. These elements may include pockets, a name plate, handles, locks, and/or the like. The illustrated embodiment consists of a pocket 114, handles 116, and shoulder strap rings 118.

The case 100 is not limited to the elements shown as various embodiments may have no pockets or even multiple pockets. The pockets may contain organizational panels, be made of nonabrasive material, or have other properties to make them suitable for various applications. Similar to the case 100, fasteners may secure the opening of the pockets shut. Embodiments may include various items such as zippers, clasps, buttons, snaps, magnets, and/or the like to secure a portion or the entire width of the opening. Further, the handles 116 may be made of flexible material, rubber, leather, or any other suitable material. The handles 116 may also include a grip, tie, and/or other elements for convenient use. These elements may be combined to form different embodiments of the case's exterior 102.

Figure 2:
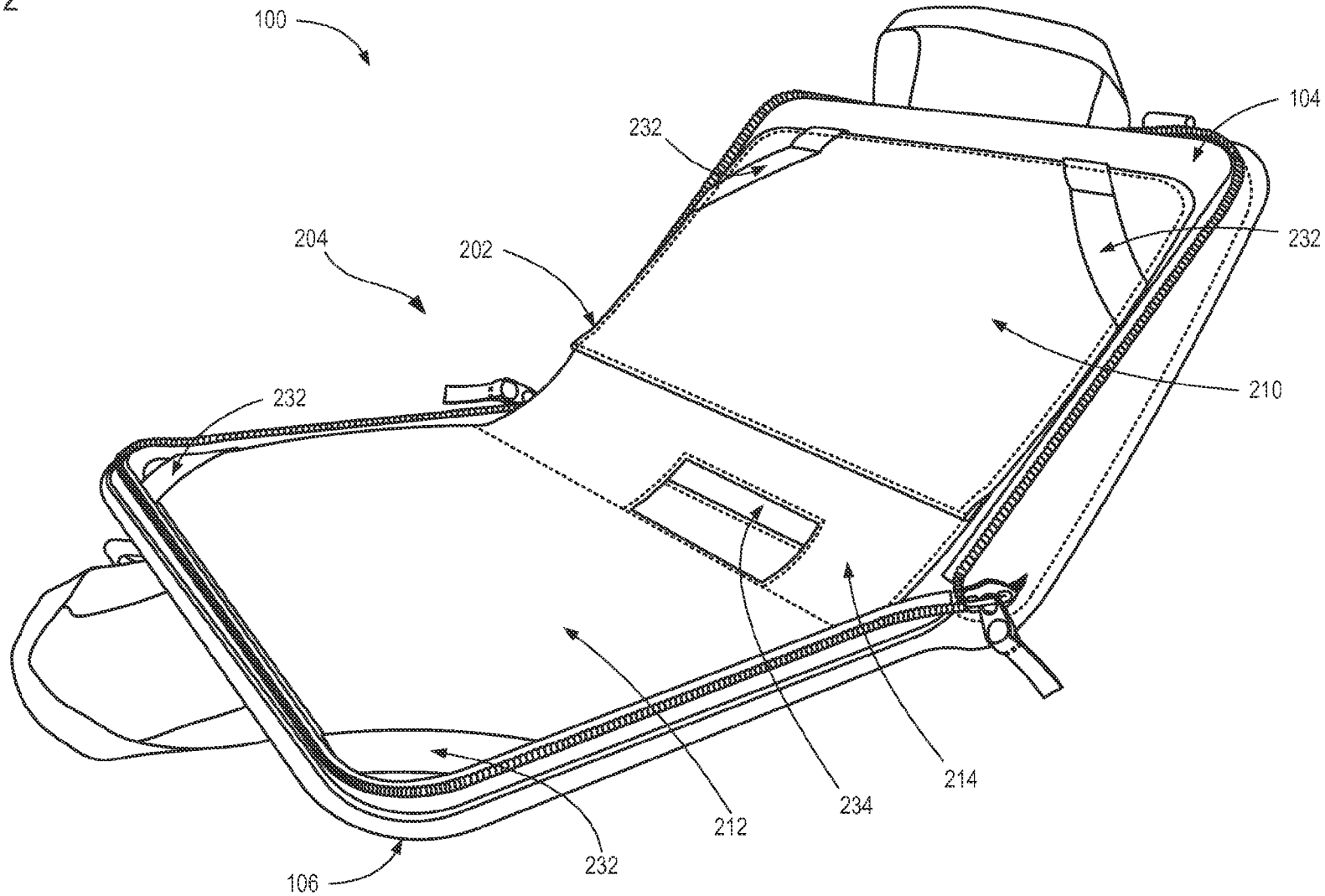
FIG. 2 is a side perspective view of the case with internal support, the case in an open position and without a PED present.
Figure 3:
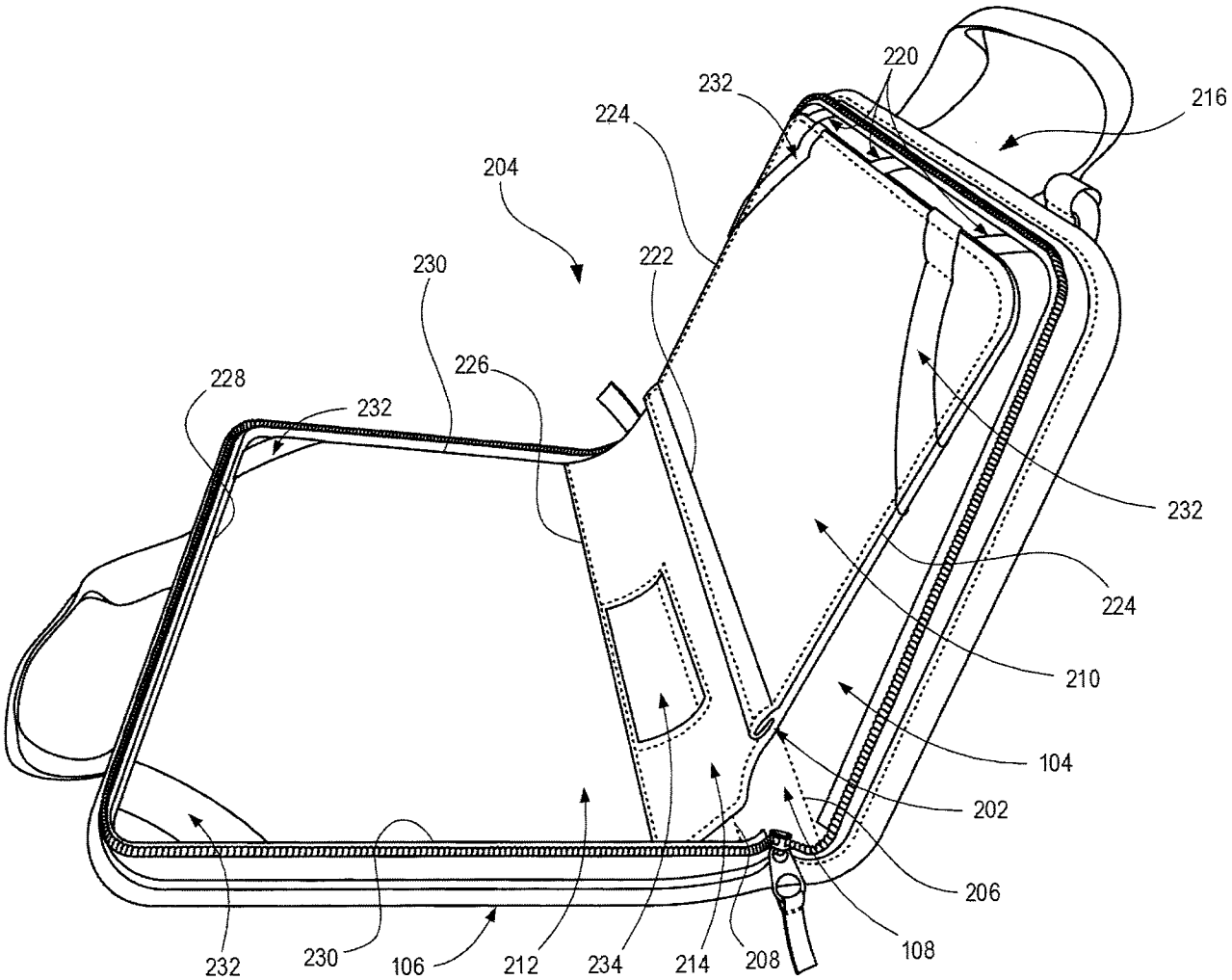
FIG. 3 is a side perspective view of the case in an open position illustrating the separation between the internal support and the case.

FIGS. 2 and 3 are side perspective views of the case 100 in an open position without a PED present. The case 100 includes an internal support 202, extending along interior surfaces of the first and second panels 104, 106 to receive and support a PED. The panels 104, 106 and bottom wall 108 define an interior storage compartment 204 configured to receive a PED. The interior surfaces of the panels 104, 106 may be cushioned to provide additional protection. As will be understood by one of skill in the art, various dimensions and/or proportions of the panels 104, 106 and bottom wall 108 may be modified to define an interior storage compartment 204 large or small enough to fit a specific PED. As can be seen in the illustrated embodiment, by having the panels 104, 106 only coupled along corresponding bottom edges 206, 208 to the bottom wall 108, the case 100 can open widely for easy access to insert, retrieve, or use a PED.

The internal support 202 is coupled to the interior surface of the panels 104, 106 either directly or indirectly through an intermediary structure. The internal support 202 provides restriction to the case 100 when the case 100 is in an open position and impact protection to an enclosed PED when the case 100 is in a closed position. The internal support 202 may be made of a soft cushioned material, leather, rubber, or other suitable material to provide additional protection. As in the illustrated embodiment, the internal support 202 may keep the panels 104, 106 of the case 100 from opening a full 180 degrees. As shown in FIGS. 2 and 3, opening the case 100 to the fullest extent provides a satisfactory angle to support and use a PED without the need to remove it from the case 100. A PED may have a display component supported in an elevated position by the panel 104 while a keyboard component is supported by the panel 106. Thus, the case 100 may not only protect an enclosed PED, but may also support the PED in an upright position. Further, when the case 100 is closed the internal support 202 may cradle a PED in a suspended position within the interior storage compartment 204 for impact protection. By suspending the PED above the bottom wall 108, the case 100 can cushion the shock of an impact.

The internal support 202 may comprise first and second internal panels 210, 212 pivotally coupled by a flexible section 214. The flexible section 214 may cradle and retain an enclosed PED within the internal support 202 for impact protection. The internal panels 210, 212 may be rigid or semi-rigid to provide additional protection and structure to the panels 104, 106 of the case 100. The first and second interior panels 210, 212 may have smaller dimensions than the first and second panels 104, 106. With a smaller dimension, the first internal panel 210 may shift during an impact to absorb the shock. The interior panels 210, 212 may nevertheless extend over the majority of the interior surfaces of corresponding panels 104, 106.

The internal panels 210, 212 may be secured to the interior surface of corresponding panels 104, 106, directly or indirectly, at one or more points of contact. For example, in one embodiment, an upper edge 216 of the internal panel 210 is secured to first panel 104 near the case's opening edge 218. The upper edge 216 of the internal panel 210 may be secured to the internal panel 210 via one or more elastic members 220. An elastic member 220 may include a strap, cord, band, or the like. An elastic member 220 allows the internal panel 210 to support the panel 104 and also allows the internal panel 210 to shift to absorb an impact. Alternatively, an internal panel 210 may be directly coupled to the panel 104 by a fastener such as stitching, adhesive, rivets, Velcro, and the like.

A lower edge 222, near the bottom wall 108, of the internal panel 210 may not be attached to the inner surface of the panel 104. This allows the internal panel 210 to pull away from the first panel 104 adjacent the bottom wall 108. The first internal panel 210 provides a better viewing angle for a secured PED when the case 100 is in an open position. The internal panel 210 may also be detached from the first panel 104 along sides 224 extending from the lower edge 222 to the upper edge 216.

In one embodiment, the second internal panel 212 may be secured to the second panel 106 in a manner different than that of internal panel 210. The second panel 212 may be directly secured to the second panel 106 along upper edge 226, lower edge 228, and sides 230. As such, elastic members are not used, and the second panel 212 and the second panel 106 do not readily move independent of one another. Securing the perimeter of the second panel 212 to the second panel 106, provides a more rigid structure when the case 100 is in an open position. Alternatively, the second internal panel 212 may be secured to the panel 106 in a manner similar to that of the attachment of the first internal panel 210 to the panel 104.

A PED may be secured to the internal panels 210, 212 in a variety of ways including elastic material, Velcro, adhesives, and the like. In one embodiment, one or more flexible bands 232 extend from and are coupled to the internal panels 210, 212. As illustrated, the flexible bands are attached to the internal panel 210, 212 corners to engage corners of a PED. Each flexible band 232 may be configured to wrap around a corner of a PED in order to secure it within the case 100. The flexible bands 232 may be manufactured using silicon, nylon, and/or other elastic material. The two panels 210, 212 may secure components of the same device such as a laptop. For example, a display may be secured to the panel 210 and a keyboard, pivotally coupled to the display, may be secured to the panel 212. Each panel 210, 212 may also secure different devices such as a tablet-like device on one panel 210 and a peripheral device, like a keyboard, on the second panel 212.

The flexible section 214, coupling the panels 210, 212 along the bottom of the case 100, both cradles the PED and allows the internal support 202 to pivot open and closed with the case 100. According to various embodiments, the flexible section 214 may include an opening 234 to accommodate cables. Although not shown in FIGS. 2 and 3, the cables may also extend through the bottom wall 108.

In operation, in a closed position, the flexible section 214 suspends a PED secured within the interior storage compartment 204 to protect against an abrupt impact. In an open position, the internal support 202 provides structure to the case 100 by way of the internal support dimensions and the attachments of the internal support 202 to the panels 104, 106. The combined dimensions of the flexible section 214 and internal panels 210, 212 are smaller than the case dimensions. This difference in size prevents the case 100 from opening a full 180 degrees. The angle to which the case 100 opens may be further defined by the way the internal support 202 is attached. By securing the second internal panel 212 along its entire perimeter, the illustrated embodiment's internal support 202 provides a flat surface when the case 100 is in an open position for convenient use of a keyboard or like peripheral. By attaching the first internal panel 210 only along its upper edge 216, the illustrated embodiment also provides a comfortable viewing angle for any type of screened PED secured to the panel 210. By stopping the case 100 from opening all the way, the internal support 202 provides a comfortable viewing angle and convenient access to a PED without the need to remove it from the case 100.

Figure 4:
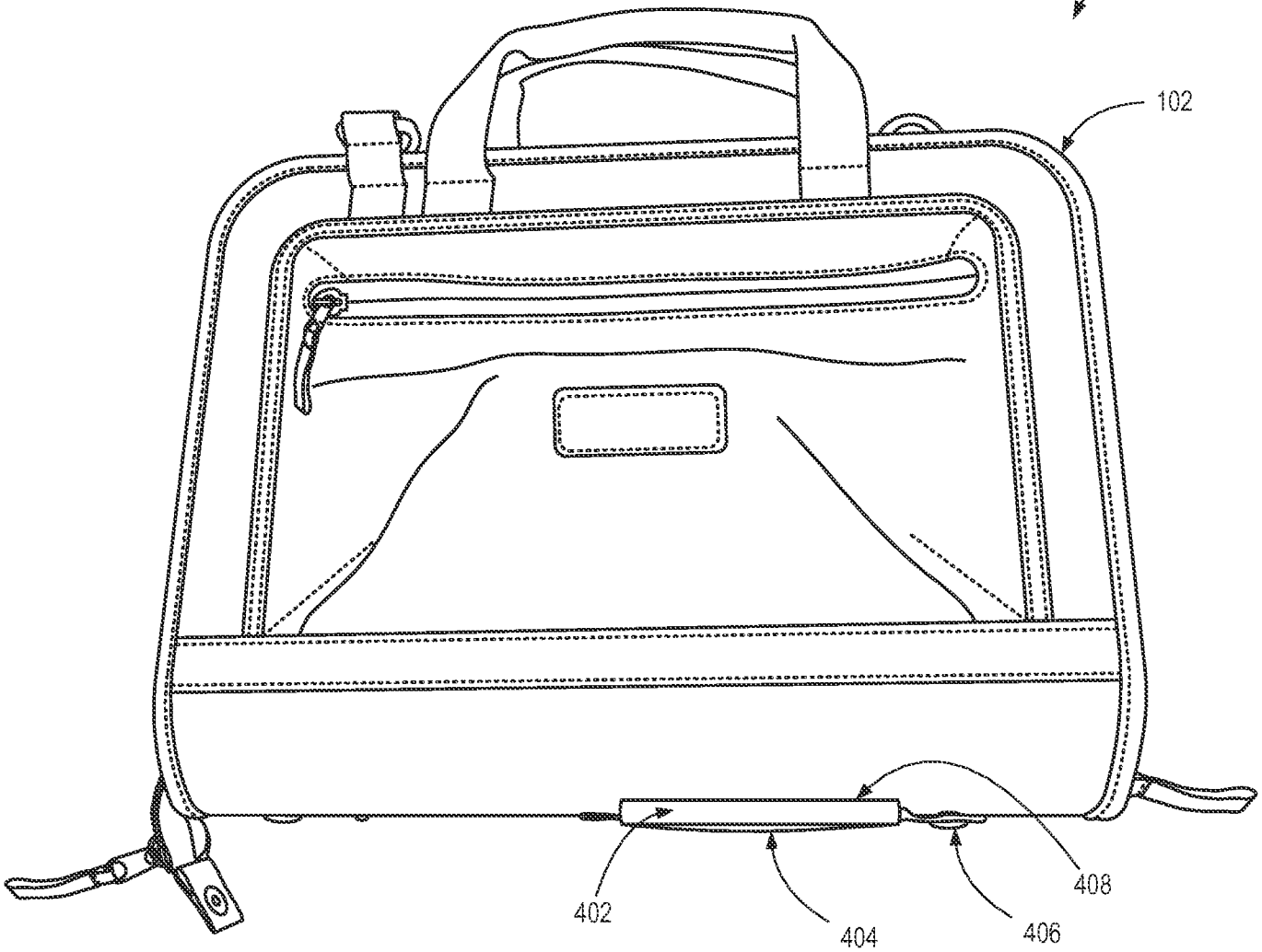
FIG. 4 is a front view of the case with internal support, the case and a port access cover in a closed position.

FIG. 4 is a front view of the case 100 in a closed position and the case 100 is shown with a port access cover 402 in a closed position. The port access cover 402 may be rubber, a heavy fabric, leather or other suitable material. The port access cover 402 may be disposed in the bottom wall 108 or adjacent to the bottom wall 108 and covers a port opening 408 in the bottom wall 108. The port opening 408 may be aligned with the opening 234 in the flexible section 214 of the internal support 202 thereby allowing easy access to a PED's ports, and space for routing cables through the case 100.

In the illustrated embodiment, the port access cover 402 may be held in a closed position by a fabric flap 404 and snaps 406. The middle of the fabric flap 404 is coupled to the port access cover 402. On one end the fabric flap 404 is pivotally coupled to the bottom wall 108. On the other end of the fabric flap 404, a snap 406 selectively couples the fabric flap 404 to the bottom wall 108. Other embodiments may use different types of fasteners such as clasps, buttons, magnets, and/or the like. Further, the fabric flap 404 may be replaced with any flexible material, strap, hinge, or the like. In a closed position, the port access cover 402 protects an enclosed PED's ports.

Figure 5:
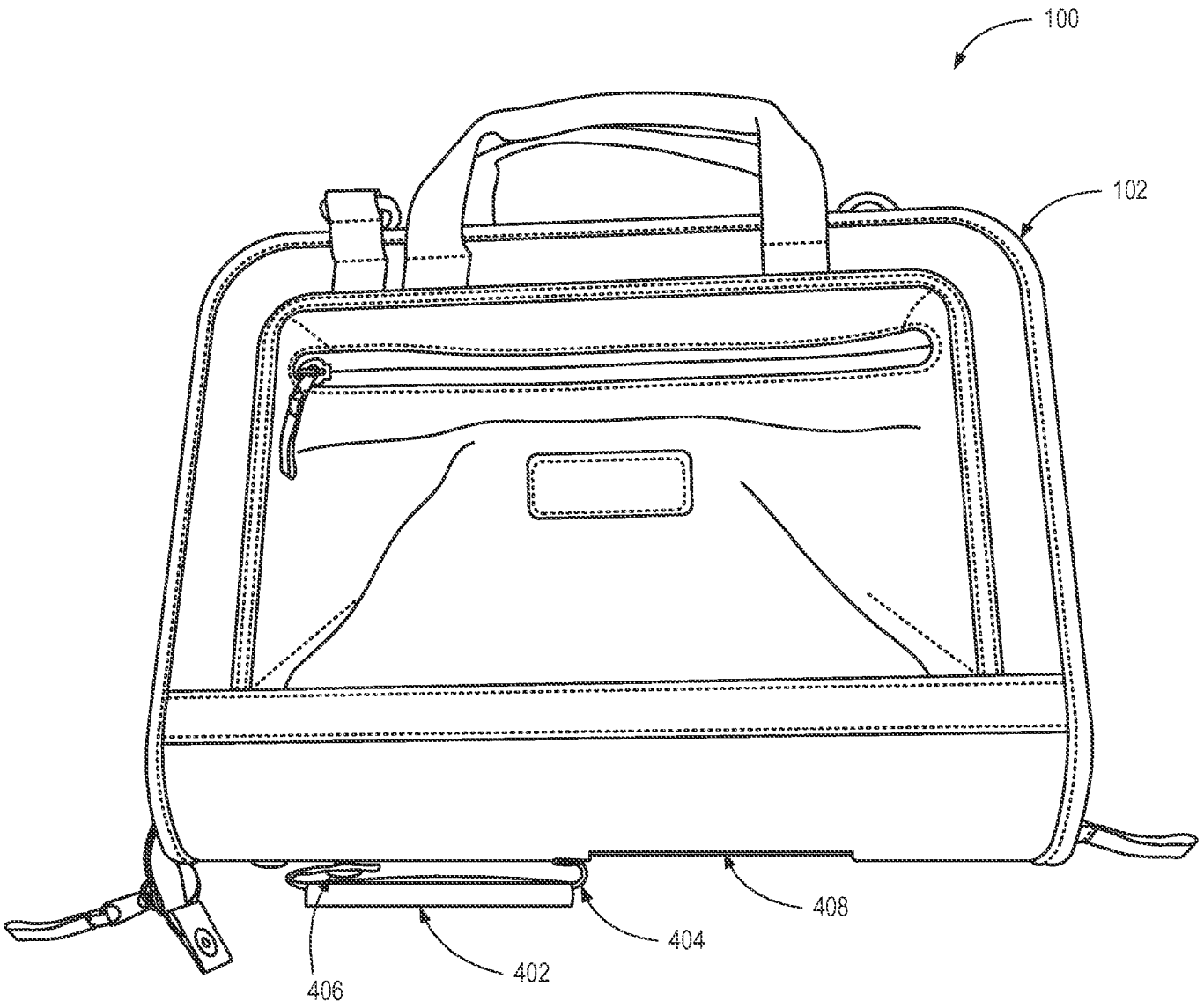
FIG. 5 is a front view of the case with internal support, the case in a closed position and the port access cover in an open position.

FIG. 5 is a front view of the case 100 in a closed position and the port access cover 402 in an open position. The port access cover 402 may be selectively opened to provide access to an enclosed PED's ports. In this open position, cables may extend through both the port opening 408 and the opening 234 in the flexible section 214 of the internal support 202. In the illustrated embodiment, the port access cover 402 is held in an open position by a fabric flap 404 and snaps 406. The fabric flap 404 allows the port access cover 402 to pivotally move from a closed position to an open position, while the snaps 406 hold the fabric flap 404 and port access cover 402 in a selected position.

The above description provides numerous specific details for a thorough understanding of the embodiments described herein. However, those of skill in the art will recognize that one or more of the specific details may be omitted, or other methods, components, or materials may be used. In some cases, operations are not shown or described in detail. Additionally, features or elements described in conjunction with any one embodiment may be adapted for use with and/or combined with the features of any other embodiment.

What is claimed:

1. A case for a portable electronic device, the carrying case comprising:

first and second panels configured to pivot relative to one another to transition from a closed position that defines an interior storage compartment for the portable electronic device, to an open position that allows access to the portable electronic device stored in the interior storage compartment; and an internal support disposed within the interior storage compartment and including, a first internal panel secured to the first panel, wherein the first internal panel includes an upper edge and the first internal panel is only secured to the first panel along at least a portion of the upper edge, a second internal panel including an upper edge and a lower edge and wherein the second internal panel is secured to the second panel along at least a portion of the upper edge and along at least a portion of the lower edge, and a flexible section coupled to the first and second internal panels, wherein in the open position, the secured first internal panel, secured second internal panel, and the flexible section restrict pivotal movement of the first and second panels, wherein in the closed position, the portable electronic device nests within the flexible section and is disposed between the first and second internal panels and between the first and second panels.

2. The case of claim 1, further comprising an elastic member to secure the first internal panel to the first panel, wherein the elastic member is coupled to the first internal panel along an upper edge of the first internal panel.

3. The case of claim 1, wherein the second internal panel includes two side edges and the second internal panel is secured to the second panel along at least a portion of each side edge.

4. The case of claim 1, further comprising a plurality of flexible bands coupled to the first and second internal panels and configured to extend around a portion of the portable electronic device to thereby secure the portable electronic device to the first and second internal panels.

5. The case of claim 1, further comprising a bottom wall coupled to the first panel and the second panel.

6. The case of claim 5, wherein the flexible section includes a section opening and the bottom wall includes a wall opening aligned with the section opening to allow access to the portable electronic device housed in the interior storage compartment.

7. The case of claim 6, further comprising a port access cover coupled to the bottom wall, wherein the port access cover is configured to selectively close the wall opening.

8. The case of claim 1, further comprising a fastener to selectively couple the first panel to the second panel.

9. The case of claim 1, wherein the first internal panel extends over the majority of the interior surface area of the first panel and the second internal panel extends over the majority of the interior of the surface area of the second panel.

10. A case for a portable electronic device, the carrying case comprising:

first and second panels having inner and outer surfaces, the outer surfaces at least partially defining an exterior surface of the case;

a bottom wall coupled to the first and second panels and configured to allow the first and second panels to pivot relative to one another to transition from a closed position that defines an interior storage compartment for the portable electronic device, to an open position that allows access to the portable electronic device;

an internal support disposed within the interior storage compartment and including, a first internal panel, a second internal panel including an upper edge and a lower edge and wherein the second internal panel is secured to the inner surface of the second panel along at least a portion of the upper edge and along at least a portion of the lower edge, and a flexible section coupled to the first and second internal panels; and an elastic member coupled to the first internal panel and the inner surface of the first panel, wherein in the open position, the first internal panel, secured second internal panel, and the flexible section restrict pivotal movement of the first and second panels, wherein in the closed position, the flexible section and the first and second internal panels are configured to receive the portable electronic device.

11. The case of claim 10, wherein the first internal panel includes an upper edge and the first internal panel is secured to the elastic member proximate to the upper edge.

12. The case of claim 10, wherein the second internal panel includes two side edges and the second internal panel is secured to the second panel along at least a portion of each side edge.

13. The case of claim 10, further comprising a plurality of flexible bands coupled to the first and second internal panels and configured to extend around a portion of the portable electronic device to thereby secure the portable electronic device to the first and second internal panels.

14. The case of claim 10, wherein the flexible section includes a section opening and the bottom wall includes a wall opening aligned with the section opening to allow access to the portable electronic device housed in the interior storage compartment.

15. The case of claim 14, further comprising a port access cover coupled to the bottom wall, wherein the port access cover is configured to selectively close the wall opening.

16. The case of claim 10, further comprising a fastener to selectively couple the first panel to the second panel.

17. The case of claim 10, wherein the first internal panel extends over the majority of the inner surface of the first panel and the second internal panel extends over the majority of the inner surface of the second panel.

* * * * *